US005860645A

United States Patent [19]

Tomura et al.

[11] Patent Number: 5,860,645

[45] Date of Patent: Jan. 19, 1999

[54] SHEET SUPPLYING APPARATUS

[75] Inventors: Hisayuki Tomura, Machida; Haruo Ishizuka, Tokyo, both of Japan

[73] Assignee: Canon Kabushiki Kaisha, Toyko, Japan

[21] Appl. No.: 733,329

[22] Filed: Oct. 17, 1996

[30] Foreign Application Priority Data

| | | | |
|---|---|---|---|
| Oct. 20, 1995 | [JP] | Japan | 7-272831 |
| Oct. 20, 1995 | [JP] | Japan | 7-272832 |
| Oct. 20, 1995 | [JP] | Japan | 7-272833 |
| Oct. 20, 1995 | [JP] | Japan | 7-272834 |

[51] Int. Cl.[6] ..... B65H 3/06

[52] U.S. Cl. ..... 271/10.13; 271/10.11; 271/114; 271/116; 271/121; 271/10.04; 271/10.05

[58] Field of Search ..... 271/10.04, 10.05, 271/10.13, 122, 116, 114, 121, 10.11

[56] References Cited

U.S. PATENT DOCUMENTS

| | | | |
|---|---|---|---|
| 5,029,837 | 7/1991 | Uchiyama | 271/110 |
| 5,039,080 | 8/1991 | Kato et al. | 271/122 |
| 5,106,071 | 4/1992 | Graham | 271/116 |
| 5,398,108 | 3/1995 | Morinaga et al. . | |
| 5,443,252 | 8/1995 | Morinaga et al. . | |
| 5,474,287 | 12/1995 | Takahashi | 271/10.13 |
| 5,571,265 | 11/1996 | Yagi et al. | 271/119 |

*Primary Examiner*—H. Grant Skaggs
*Assistant Examiner*—Patrick Mackey
*Attorney, Agent, or Firm*—Fitzpatrick, Cella, Harper & Scinto

[57] ABSTRACT

A sheet supplying apparatus which has a feed roller rotated in a sheet feed direction, a retard roller capable of being urged against the feed roller and adapted to separate sheets one by one between the retard roller and the feed roller, a first drive transmitting mechanism capable of transmitting or interrupting a driving force from a drive source to the feed roller and the retard roller, a second drive transmitting mechanism for transmitting a rotation of the feed roller to the retard roller, and a convey roller disposed downstream of the feed roller in the sheet feed direction for receiving and conveying the sheet fed out by the feed roller and which is rotated by transmitting the driving force of the first drive transmitting mechanism.

20 Claims, 11 Drawing Sheets

SHEET SUPPLYING APPARATUS

BACKGROUND OF THE INVENTION

1. Field of the Invention

The present invention relates to a sheet supplying apparatus for separating and supplying sheets one by one to an image forming portion regarding originals set in an original reading apparatus.

The sheet may be a cut sheet such as a transfer sheet, photosensitive sheet, a heat-sensitive sheet, an electrostatic recording sheet, a print sheet, an original, a card or an envelope supplied to an office equipment or other sheet using apparatus such as a copying machine, a printer, a printing apparatus, a facsimile and the like. The sheet is not limited to a paper sheet.

2. Related Background Art

Conventional control effected in a copying operation for copying an original in a copying machine using an electrophotographic apparatus will now be explained with reference to FIGS. 13 and 14.

When originals are set at a reading portion by an operator and a copy start button is depressed, a recording motor Ml is driven on the basis of a signal from a CPU provided on a DC controller base plate. After a predetermined time period is elapsed, when a signal for effecting the supplying of a recording sheet is transmitted from the CPU to a recording portion, sheet supply clutches (CL1, CL4) are turned ON to rotate a sheet supply roller 206, thereby supplying the recording sheet from a sheet supply portion. Thereafter, sheet supply roller release solenoids (SL1, SL2) are turned ON to separate the sheet supply roller 206 from the recording sheet.

The fed recording sheets are separated one by one by a convey roller 207 and a separation roller 208, and the separated recording sheet is sent to a convey path. When a predetermined time period is elapsed after the sheet supply clutches (CL1, CL4) are turned ON, vertical path roller drive clutches (CL2, CL3) are turned ON, with the result that the recording sheet is conveyed by vertical path rollers 209 set to permit conveyance of a small size sheet. Even after the recording sheet reaches the vertical path rollers (next stage convey means) 209, since the sheet supply clutches (CL1, CL4) are still being turned ON, the separation roller 208 is rotated in the same direction as the convey roller 207, thereby preventing recording sheets other than an uppermost recording sheet from entering into a nip between the convey roller 207 and the separation roller 208.

When a predetermined time period is elapsed after the vertical path roller drive clutches (CL2, CL3) are turned ON, a pre-regist roller drive clutch (CL9) is turned ON, with the result that the recording sheet is sent to a pair of regist rollers 211 by a pair of rotating pre-regist rollers 210. A sensor (not shown) is disposed in front of the pair of pre-regist rollers 210 so that, if the recording sheet does not reach the sensor within a predetermined time period, it is judged that a jam condition occurs. When a predetermined time period is elapsed after the recording sheet reaches the pair of pre-regist rollers 210, the sheet supply clutches (CL1, CL4) are turned OFF.

The recording sheet conveyed to the regist rollers 211 abut against a nip of the regist rollers 211 (which are now stopped since a regist roller drive clutch (CL8) is turned OFF), thereby forming a loop in the sheet to correct the skew-feed of the recording sheet. Thereafter, the recording sheet is held by the regist rollers 211. A motor of an optical system starts to be driven by ON/OFF of the regist rollers 211, so that the original is exposed by an original exposure lamp 212 and light reflected from the original is illuminated onto a CCD portion 214 through mirrors 213. By controlling ON/OFF of a laser 215 on the basis of the image information of the original read by the CCD portion 214, a dot pattern image is formed on a photosensitive drum 216. The electrostatic latent image formed on the photosensitive drum 216 is visualized by a developing portion 217 of the recording portion with toner as a toner image.

The regist rollers are driven so that an image tip end of the toner image formed on the photosensitive drum 216 coincides with a tip end of the recording sheet, and the image on the photosensitive drum 216 is transferred onto the recording sheet by a transfer charger 218. The toner image rested on the recording sheet is conveyed to a fixing portion 220 by a convey portion 219 without applying vibration to the recording sheet. In the fixing portion, heat and pressure are applied to the recording sheet, thereby fixing the toner image to the sheet as a permanent image. The recording sheet on which the image information was copied is discharged onto a discharge tray (removably attached to the copying machine) through a discharge portion 221.

In the above-mentioned conventional technique, it is required to continuously apply electric power to the electromagnetic clutches, thereby increasing the power consumption. Further, since the retard roller is rotated for a long time, the durability is worsened due to wear and the like. The sensors and the like are required to detect the position of the recording sheet in order to control the electromagnetic clutches, thereby making the construction complicated. Further, since the electromagnetic clutches must be controlled on the basis of signals from the sensors, the control becomes complicated.

SUMMARY OF THE INVENTION

An object of the present invention is to provide a sheet supplying apparatus or a controlling method, in which double-feed of sheets can be prevented with a simple construction without using any electromagnetic clutch.

A sheet supplying apparatus according to the present invention comprises a feed means rotated in a sheet feed direction, a retard or retract means provided to be urged against the feed means and adapted to separate sheets one by one between the retard means and the feed means, a first drive transmitting means capable of transmitting or interrupting a driving force from a drive source to the feed means and the retard means, a second drive transmitting means for transmitting a rotation of the feed means to the retard means, and a convey means disposed at a downstream side of the feed means in the sheet feed direction for receiving and conveying the sheet fed out by the feed means rotated by transmitting the driving force to the feed means by the first drive transmitting means. Wherein, when the first drive transmitting means is changed from a transmission condition to an interruption condition, the rotation of the feed means rotatingly driven by the sheet conveyed by the convey means is transmitted to the retard means by the second drive transmitting means.

Further, a control method for controlling the sheet supplying means according to the present invention comprises the steps of separating sheets one by one between a feed means to which a driving force is transmitted from a drive source and which is rotated in a sheet feed direction and a retard means to which a driving force is transmitted from the drive source and which is rotated in a direction opposite to the sheet feed direction, interrupting the transmission of the driving force from the drive source to the feed means and the retard means after conveyance of the sheet separated by the feed means and the retard means is started by a convey means disposed at a downstream side in the sheet feed direction, and transmitting a rotation of the feed means rotatingly driven by the sheet conveyed by the convey means to the retard means after the transmission of the driving force from the drive source is interrupted, thereby preventing double-feed of sheets.

DETAILED DESCRIPTION OF THE PREFERRED EMBODIMENTS

<Entire Construction>

The entire construction of a facsimile system according to a first embodiment of the present invention will be explained briefly with reference to FIGS. 4 to 6.

Figure 4:
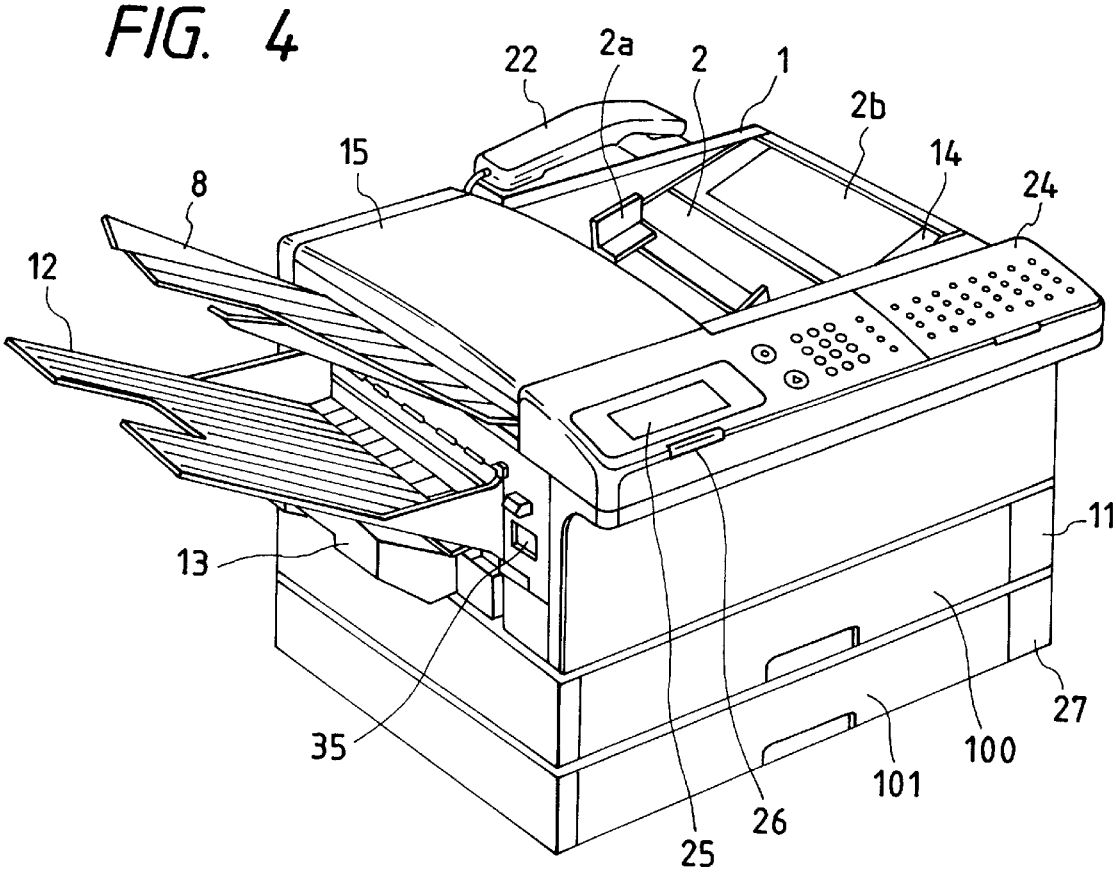
FIG. 4 is a perspective view of an image forming apparatus according to the present invention.
Figure 5:
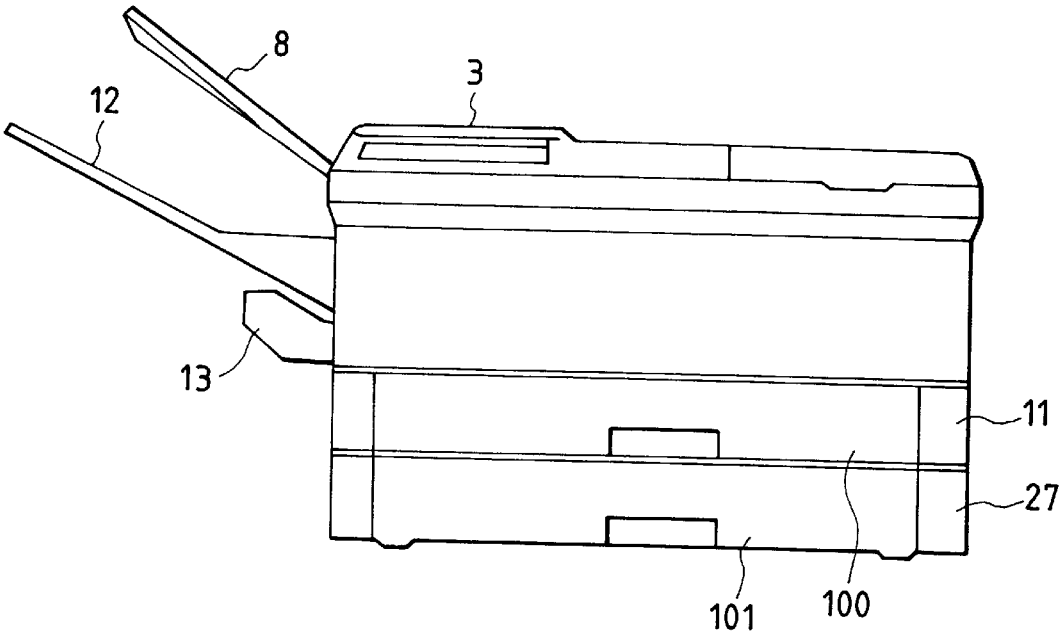
FIG. 5 is a front view of the image forming apparatus.
Figure 6:
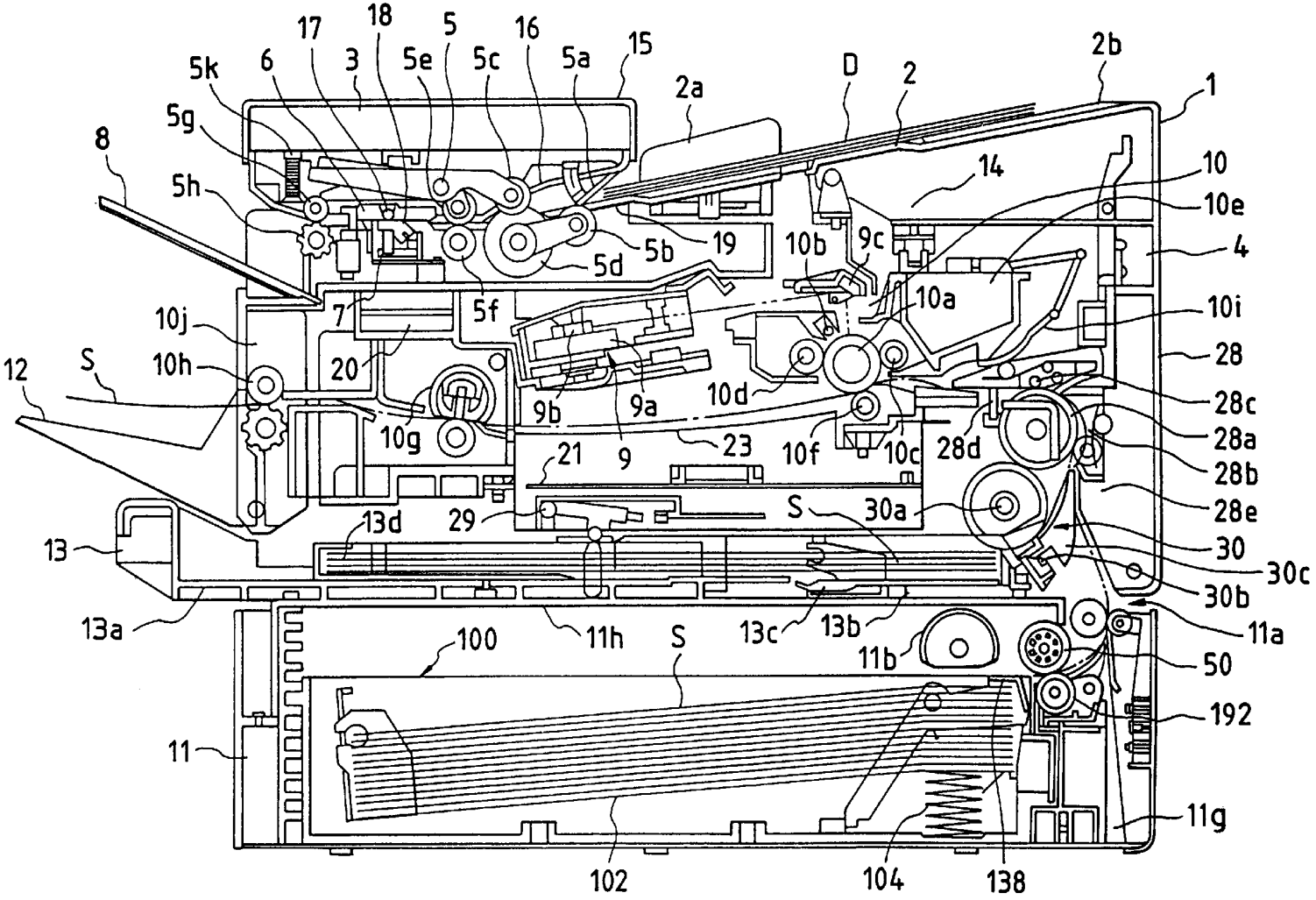
FIG. 6 is an elevational sectional view of the image forming apparatus showing an internal construction thereof.
Figure 7:
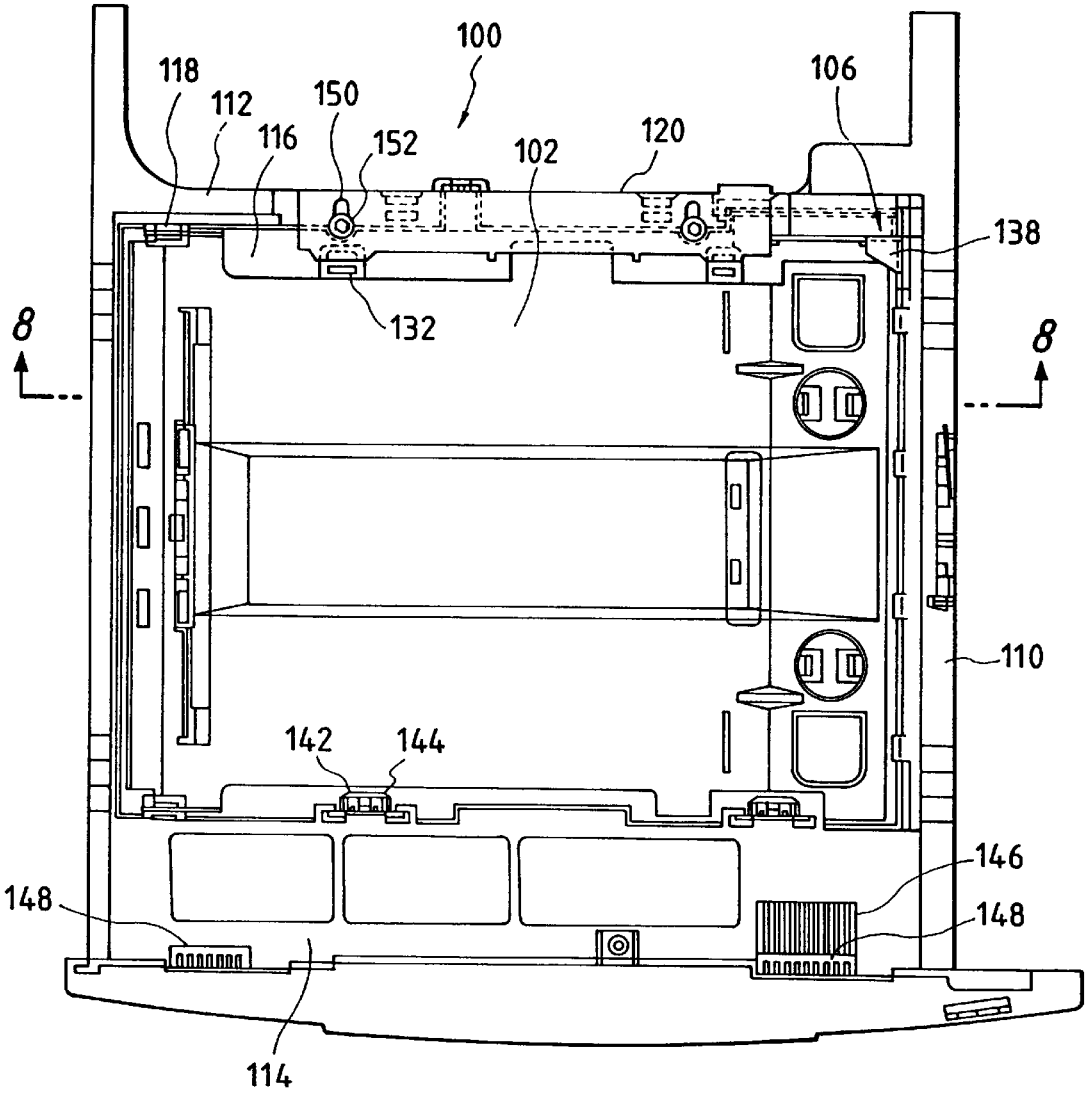
FIG. 7 is a plan view of a sheet stacking portion according to a first embodiment of the present invention.

In FIGS. 4 to 6, the reference numeral 1 denotes a body of the facsimile system; 2 denotes an original stacking plate formed on an upper cover of the facsimile system 1 and on which a plurality of originals D can be stacked; 3 denotes an image reading portion for reading image information on the original; 4 denotes a recording portion including a laser beam printer; 5 denotes an original convey portion; 6 denotes an original urging portion; 7 denotes an image sensor of close contact type; 8 denotes an original discharge tray; 9 denotes a laser scanner; 10 denotes an image forming portion; 11 denotes a sheet supply portion of a sheet stacking device; 12 denotes a recording sheet discharge tray; 13 denotes an MP sheet (multi recording sheet) stacking device; 14 denotes a cartridge cover; 15 denotes an ADF (automatic original feeder) cover; 16 denotes an upper original guide; 17 denotes a weight shaft; 18 denotes an original hold-down plate; 19 denotes a lower original guide; 20 denotes a partition portion between the image reading portion and the recording portion; 21 denotes a control portion of the facsimile system; 22 denotes a hand set; 23 denotes a convey guide; 24 denotes an operation portion; 25 denotes a display portion; 26 denotes tally lamp showing an operating condition of the facsimile system; 27 denotes a second stage sheet stacking portion; 28 denotes a light cover (cover member); 29 denotes a sensor of the MP sheet stacking device; and 30 denotes an MP separation portion.

In the image reading portion 3, the originals D stacked on the original stacking plate 2 are separated one by one by means of an auxiliary convey roller 5*b* urged against an auxiliary convey urging member 5*a* and a separation roller 5*d* urged against a reverse rotation roller 5*c*. The separated original is conveyed to the image sensor 7 of close contact type by means of a sheet supply roller 5*f* contacted with a sheet supply sub-roller 5*e* urged by an urging spring 5*k*. At the original urging portion 6, the original D is closely contacted with the image sensor 7 of close contact type by the weight shaft 17 and the original hold-down plate 18; meanwhile, image information on the original D is read. Thereafter, the original D is discharged onto the original discharge tray 8 by means of a discharge roller 5*h* contacted with a discharge sub-roller 5*g* urged by the urging spring 5*k*. Meanwhile, the original D is guided by the upper original guide 16 and the lower original guide 19.

A slider 2*a* slidable in a direction (width-wise direction of the original) perpendicular to an original conveying direction is provided on the original stacking plate 2 so that lateral edges of the originals D stacked on the original stacking plate 2 can be aligned with each other by the slider 2*a*. Further, when the original is elongated, by opening or extending an extension original tray 2*b*, the trail end portions of the originals can be prevented from protruding and depending from the original stacking plate 2.

In the recording portion 4, a modulated signal is emitted from a laser beam generator 9*a* of the laser scanner 9 in response to an image signal outputted from the control portion 21, and the modulated beam is illuminated on a photosensitive drum 10*a* of the image forming portion 10 by a polygon mirror 9*b*, thereby forming an image information image on the surface of the photosensitive drum 10*a*. The image information image is transferred onto a sheet (recording sheet) S supplied from the sheet supply portion 11 of a sheet stacking device or the second stage sheet stacking portion 27 or the MP sheet stacking device 13 to the image forming portion 10. Then, the sheet is discharged onto the recording sheet discharge tray 12.

The photosensitive drum 10*a* is incorporated into a recording cartridge 10*e* together with a first charger 10*b*, a developing roller 10*c* and a cleaning roller 10*d*, thereby forming a cartridge which can removably be mounted to the facsimile system 1. The surface of the photosensitive drum 10*a* is uniformly charged by the first charger 10*b*, and a latent image is formed on the photosensitive drum by illuminating the scanning light from the polygon mirror 9*b* through a reflection mirror 9*c*. The latent image is visualized by toner supplied from the developing roller 10*c* as a toner image.

A transfer charger 10*f* is disposed around the photosensitive drum 10*a* of the image forming portion 10, and a thermal fixing device 10*g* and a discharge roller 10*h* are disposed in a recording sheet convey path at a downstream side of the photosensitive drum 10*a*. After the toner image formed on the photosensitive drum 10*a* was transferred to the recording sheet S by the transfer charger 10*f*, the recording sheet S is guided along the convey guide 23 to reach the thermal fixing device 10*g*, where the toner image is fixed to the recording sheet. Then, the recording sheet is discharged onto the recording sheet discharge tray 12 by the discharge roller 10*h*.

The MP sheet stacking device 13 is disposed at a bottom portion of the facsimile system 1. A sheet stack S rested on an MP sheet stacking portion 13*a* of the MP sheet stacking device is urged against an MP separation roller 30*a* by rocking an MP intermediate plate 13*c* upwardly by means of an urging member 13*b*, so that the sheets are separated one by one by means of the MP separation roller 30*a* and an MP separation pad 30*b* (friction separation method), and the separated sheet is conveyed along an MP separation base 30*c* and is further reversely rotated by a cover side U-turn guide 28*b* provided on the light cover 28 and a body side U-turn guide 28*c* provided on the system body 1. Further, a tip end of the sheet S being conveyed is detected by a regist sensor 28*d*, with the result that the sheet supply and image output timings are determined so that an image tip end of the toner image formed on the photosensitive drum 10*a* coincides with the tip end of the sheet S. Then, the sheet is sent between the transfer charger 10*f* and the photosensitive drum 10*a*. The image is recorded on a lower surface of the sheet S which was rested on the MP sheet stacking portion 13*a*.

Further, the sheets S are regulated at lateral edges and rear end thereof by an MP regulating plate 13*d* shiftable in accordance with the sheet size, thereby preventing the skew-feed and poor feed of the sheet. Furthermore, the size and presence/absence of the sheet are detected by the sensor 29 of the MP sheet stacking device. One hundred of sheets can be stacked on the MP sheet stacking device 13, and the MP sheet stacking device can be retracted to the left (side loading type). Further, the sheet having A4 size, Letter size and Regal size (three sizes) can be rested on the MP sheet stacking portion 13*a*, and, in FIG. 6, the MP regulating plate 13*d* is set to receive A4 size sheets.

The sheet supply portion 11 of a sheet stacking device is disposed in such a manner that a top plate 11*h* of the sheet supply portion 11 is contacted with the bottom of the system body 1 so that an upper surface of the top plate 11*h* constitutes a bottom plate of the system body. The sheets S stacked on the sheet supply stacking device 100 are fed out by a semi-circular sheet supply roller 11*b* against which the sheet stack is urged by lifting an intermediate plate 102 by means of an intermediate plate spring 104 and are separated one by one by a separation means which will be described later. The separated sheet S is conveyed by a pair of convey rollers 11*a* and is passed between the MP separation base 30*c* and a sheet pass guide 28*e* and then is reversely rotated by the convey roller 28*a*, the cover side U-turn guide 28*b* provided on the light cover 28 and the body side U-turn guide 28*c* provided on the system body 1. From this point, the sheet is conveyed in the same manner as the sheet from the MP sheet stacking portion 13. The sheet paths are joined together in front of the convey roller 28*a*. The image is formed on a lower surface of the sheet S rested on the sheet supply stacking device 100.

Although the second stage sheet stacking portion 27 is not shown in FIG. 6, it has substantially the same construction as the sheet supply portion 11 of a sheet stacking device, and the sheets S contained within the second stage sheet stacking device 101 is supplied to the recording portion 4 through a side space 11*g* of the sheet supply portion 11. Both the sheet stacking devices 100, 101 have sheet stacking ability of 500 sheets and can be retracted toward a front side (front loading type). Further, two kinds of sheet sizes, i.e. A4 size and a Letter size can be used.

The sheet stacking device supply portion 11 and the second stage sheet stacking device supply portion 27 can be connected and disconnected with respect to the system as option so that the sheet containing ability of the entire system can be changed from 100 sheets (there are no sheet stacking portion) to 1100 sheets (there are two sheet stacking portions).

The cartridge cover 14 can be opened and closed with respect to the system body 1 so that, when the cartridge cover 14 is opened, the recording cartridge 10*e* can be dismounted from the system body 1 to exchange it to a new one. Further, the cartridge cover 14 is provided with an interlock mechanism so that the recording portion 4 is not driven when the cartridge cover 14 is opened or when the recording cartridge 10*e* is not mounted on the system body 1. A drum exposure preventing shutter 10*i* provided on the recording cartridge 10*e* is driven in synchronous with the mounting movement of the recording cartridge 10*e* to the system body 1 so that the shutter 10*i* is opened when the recording cartridge 10*e* is mounted to the system body 1 after the cartridge cover 14 is opened and the shutter 10*i* is closed when the recording cartridge 10*e* is dismounted from the system body 1, thereby preventing the undesired exposure of the photosensitive drum 10*a*.

If the sheet jam occurs during the recording operation, the jammed sheet S can be removed by opening the cartridge cover 14, the light cover 28, or a discharge cover 10*j*. Further, the discharge cover 10*j* should be opened after the recording sheet discharge tray 12 is removed.

The partition portion 20 comprises a duct for isolating the image reading portion 3 from the recording portion 4. By flowing air through the duct by means of a fan (not shown), the image reading portion 3 is prevented from being affected by a bad influence due to the heat from the recording portion 4 and the vapor generated from the heated sheet S is prevented from dewing on the sheet S. In the image sensor 7 of close contact type, light emitted from an LED array as a light source is illuminated on the image information surface of the original D and the light reflected from the image information surface is incident to a sensor element through a SELFOC lens, thereby reading the image information.

Incidentally, while the present invention was explained with respect to the facsimile system, it should be noted that the present invention can be applied to other image forming apparatuses.

<Construction of Sheet Supply Portion>

Figure 1:
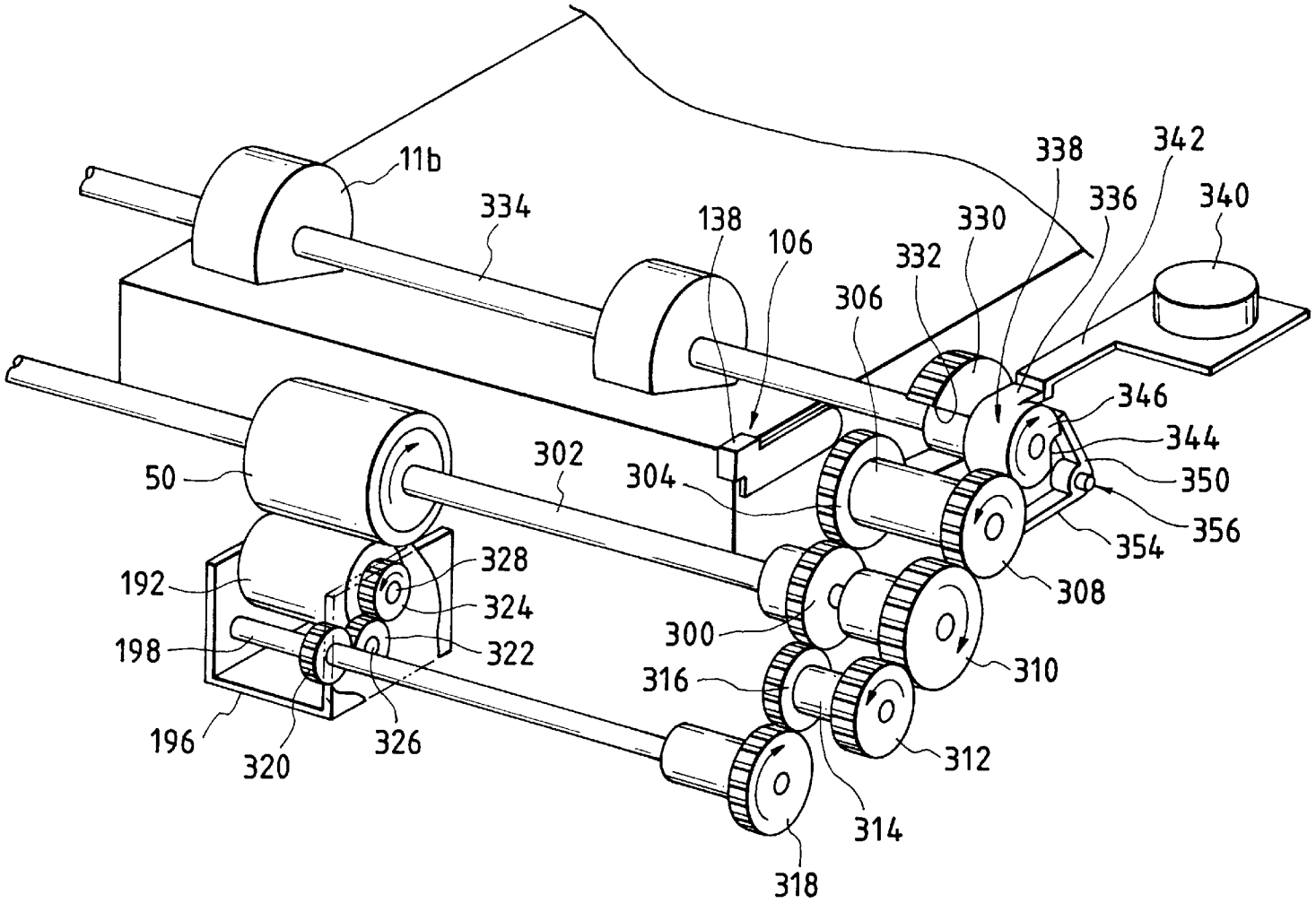
FIG. 1 is a perspective view of a sheet supply portion of a sheet supplying apparatus according to a first embodiment of the present invention.
Figure 2:
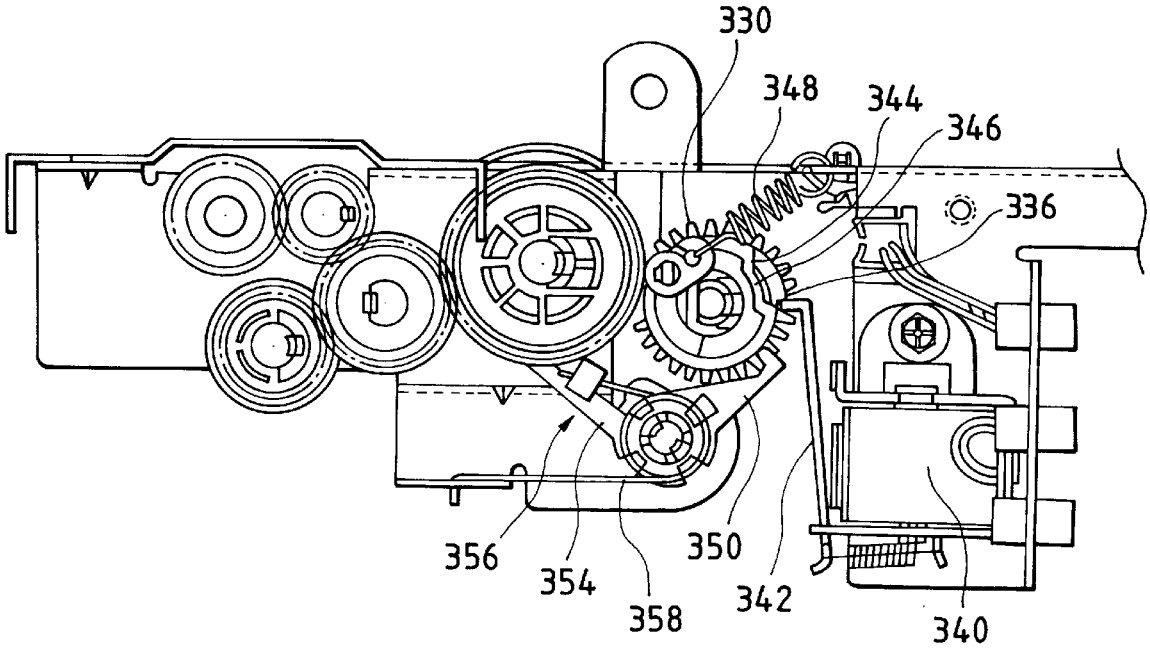
FIG. 2 is an explanatory view of the sheet supply portion in a waiting condition.
Figure 3:
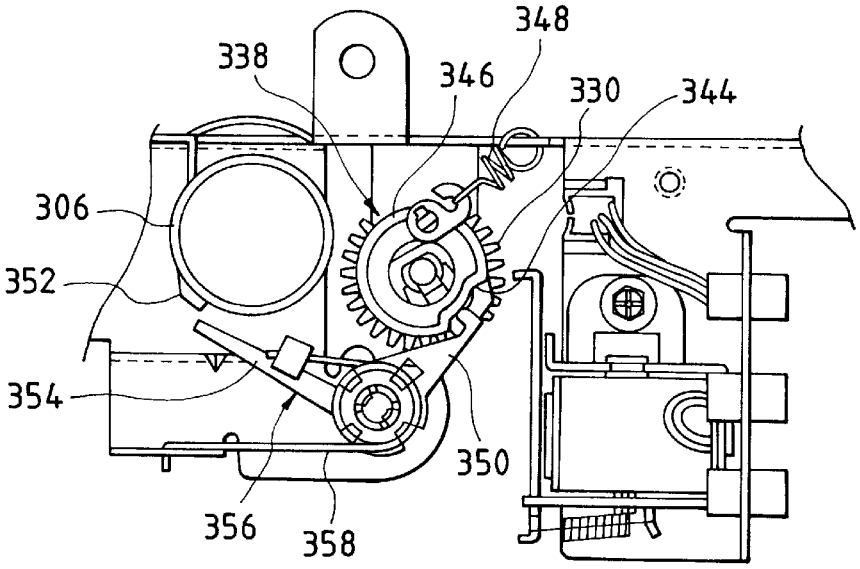
FIG. 3 is an explanatory view of the sheet supply portion in a sheet supplying condition.

Next, an embodiment of the sheet supply portion 11 of the sheet stacking device will be explained with reference to FIGS. 1 to 3. In FIGS. 1 to 3, a first gear 300 acting as a drive gear of the sheet supply portion is subjected to a driving force or rotating force from a motor (not shown) through appropriate intermediate gears and is rotatably mounted on a feed roller shaft 302 secured to the feed roller 50. The rotation of the first gear 300 is transmitted to a second gear 304, and the rotation of the second gear 304 is transmitted to a third gear 308 through a one-way clutch 306 such as a spring clutch. The rotation of the third gear 308 is transmitted to a fourth gear (feed roller gear) 310 secured to the feed roller shaft 302. The rotation of the fourth gear 310 is transmitted to a fifth gear 312, a torque limiter 314 and a sixth gear 316, and the rotation of the sixth gear 316 is transmitted to a transmission shaft 198 through a seventh gear 318. The rotation of the transmission shaft 198 is transmitted to a retard roller 192 through eighth, ninth and tenth gears 320, 322, 324 in a holder 196. The gear 322 is rotatably mounted on the holder via a support shaft 326, and the retard roller 192 and the gear 324 are rotatably mounted on the holder via a support shaft 328. In this way, the retard roller 192 is rotated by the rotational force of the first gear 300.

A notched gear 330 has a notched portion 332 corresponding to the second gear 304 and is secured to a pick-up roller shaft 334 of a semicircular pick-up roller 11*b*. A control ring 338 having a notched portion 336 is secured to one end of the pick-up roller shaft 334, and a pawl member 342 driven by a solenoid 340 can be engaged by the notched portion 336. The control ring 338 is provided with a cam ring 346 having a recessed portion 344, and a spring 348 extends between the control ring 338 and the system body. An L-shaped operation lever 356 having a first operation arm 350 engaged by the cam ring 346 and a second operation arm 354 engaged by a projection 352 of the one-way clutch 306 is pivotally mounted on the system body and is biased toward an anti-clockwise direction (FIG. 3) by a spring 358. In a condition that the second operation arm 350 is engaged by the projection 352, the one-way clutch 306 is in an inoperative condition so that the transmission of the driving force from the second gear 304 to the third gear 308 is interrupted.

Explaining an operation of the sheet supply portion, first of all, in a waiting condition shown in FIG. 2, when the solenoid 340 is energized, the engagement between the pawl member 342 and the notched portion 336 is released by the operation of the solenoid, with the result that the control ring 338 is rotated in a clockwise direction (FIG. 2) under the action of the spring 348. As a result, the notched gear 330 coaxial with the control ring 338 is engaged by the second gear 304 and is rotated by the second gear. The rotation of the notched gear is transmitted to the pick-up roller 11*b* through the shaft 334. Consequently, the pick-up roller 11*b* supplies the uppermost sheet in the sheet stacking device to the feed roller 50. In this case, immediately before the rotating pick-up roller 11*b* is engaged by the sheet, the operation arm 350 is engaged by the recessed portion 344 of the cam ring 346, with the result that the operation lever 356 is rotated in the anticlockwise direction, thereby releasing the engagement between the operation arm 354 and the projection 352.

As a result, the one-way clutch 306 is brought to the driving force transmission permitting condition, so that the driving force from the first gear 300 is transmitted through the second gear 304, one-way clutch 306, third gear 308, fourth gear 310 and shaft 302, thereby rotating the feed roller 50. Further, the driving force from the fourth gear 310 is transmitted through the fifth to tenth gears 312, 316, 318, 320, 326 and 328, thereby rotating the retard roller 192. Accordingly, the sheets are separated one by one by means of the feed roller 50 and the retard roller 192, and the separated sheet is sent to the downstream paired convey rollers 11*a*.

When the notched gear 330 is rotated by one revolution to reach a position shown in FIG. 1, the pawl member is returned to its initial position by a spring (not shown) by disenergizing the solenoid and is engaged by the notched portion 336 of the control ring 338, thereby stopping the notched gear 330. As a result, the pick-up roller 11*b* is also stopped, thereby returning to a waiting condition for the next sheet supply. On the other hand, the one-way clutch 306 is rotated since the projection 352 is disengaged from the operation arm 354. When the one-way clutch is rotated by one revolution, the operation arm 350 is disengaged from the recessed portion 344, thereby returning the operation lever 356 to a condition shown in FIG. 2. As a result, the projection 352 is engaged by the operation arm 354 again to bring the one-way clutch 306 to the driving force transmission interrupting condition. An amount of rotation of the feed roller 50 until the one-way clutch 306 is rotated by one revolution from the driving force transmission permitting condition to the driving force transmission interrupting condition is selected so that the fed sheet is positively pinched and conveyed by the downstream convey means.

In the above-mentioned sheet supplying apparatus, since the pick-up roller 11*b* and the retard roller 192 are synchronously rotated through the second to tenth gears, one-way clutch 306 and torque limiter 314 to separate the sheet and to supply the separated sheet to the downstream convey roller portion, unlike the conventional techniques, there is no need to provide electromagnetic clutches for controlling the pick-up roller 11*b* and the retard roller 192 independently, thereby making the construction simpler. Further, even after the one-way clutch 306 becomes the driving force transmission interruption condition not to transmit the driving force to the feed roller 50, since the feed roller 50 and the retard roller 192 are interconnected through the fourth and fifth gears 310, 312, torque limiter 314 and sixth and seventh gears 316, 318, the rotation of the feed roller 50 rotatingly driven by the sheet S being conveyed by the downstream paired convey rollers is transmitted to the retard roller 192, thereby preventing the double-feed of sheets.

Further, since the action of the one-way clutch 306 for permitting the driven rotation of the feed roller 50 by the movement of the sheet S being conveyed by the downstream paired convey rollers can be effected by the one-way clutch 306 for rotating the pick-up roller 11*b* by one revolution, the number of parts is reduced, thereby making the construction simpler and reducing the manufacturing cost. In addition, since the retard roller is not rotated excessively, the wear is minimized. Thus, cheap roller can be used.

Further, immediately before the rotating pick-up roller is contacted with the sheet S, the rotation of the feed roller is started with certain delay from the initiation of rotation of the pick-up roller, thereby supplying the sheet by the predetermined amount, and, when these rollers are rotated by one revolution, these rollers are stopped. Thus, there is no useless rotation of the feed roller, and, thus, a diameter of the feed roller can be made smaller. In this case, the delay in initiation of rotation of the feed roller with respect to that of the pick-up roller can be appropriately set by a cam portion.

<Construction of Sheet Shocking Portion>

Next, an embodiment of the sheet stacking device (sheet cassette) will be explained with reference to FIGS. 7 to 10. In FIGS. 7 to 10, the sheet stacking device 100 has a pair of side plates, a rear plate 112 extending between the side plates at a rear part of the apparatus, a front plate 114 extending between the side plates at a front part of the apparatus, and a bottom plate 116. Further, the intermediate plate 102 biased by the spring 104 is supported by the rear and front plates via pins 118.

An abutment member 120 provided at the rear part of the sheet stacking device has an upper wall portion 122 corresponding to the top of the rear plate 112 and a vertical wall portion 124 corresponding to a side of the rear plate 112. The upper wall portion 122 is provided with a pair of elongated slots 126, and the vertical wall portion 124 is provided with projections 128 for regulating one side of the sheet, i.e. left side with respect to the sheet supply direction (upper side in FIG. 7) and is also provided at its lower end with a pair of projections 130 which can be engaged by an appropriate number of adjustment holes 132 formed in the bottom plate 116 of the sheet stacking device. A pawl member 106 disposed forwardly of the abutment member 120 in the sheet supply direction has a plate-shaped body portion 136 having a guide hole 134, and a pawl portion 138 and is pivotally supported by the vertical wall portion 124 via a pin 140. Although the pawl member 106 has a sheet separating ability, main role of the pawl member is to regulate the position of the sheet stack. The pawl member 106 is positioned only at one side of the device to reduce the manufacturing cost.

At a front side of the sheet stacking device, i.e. inside the front plate 114, there is provided a biasing means 144 comprising a plate-shaped member 142 for pushing the other side of the sheet stack and a spring (not shown) for biasing the plate-shaped member. Further, a positioning means 146 having an L-shaped or other appropriate shaped cross-section is disposed at an upper portion of the front plate 114 so that the sheet stacking device can be positioned by a reference surface 148 of the positioning means.

With the arrangement as mentioned above, the projections 130 of the abutment member 120 are fitted into the adjustment holes 132 (of the bottom plate of the sheet stacking device) selected in accordance with the sheet size, and the abutment member is secured to the rear plate 112 by a screw 152 passing through the elongated slot 150. In this condition, when a predetermined number of sheets are contained in the sheet stacking device, the sheet stack is urged against the abutment member 120, with the result that one side of the sheet stack is regulated by a reference plane defined by the projections 128. In such a condition, when the sheet stacking device is mounted on the system body, since the position of the sheet stack is regulated by the abutment member, positional deviation (as is in the conventional front regulating techniques) can be prevented, the sheet stack can be maintained at the predetermined position, the sheet stack cannot escape from the pawl member and the good sheet conveyance can be performed.

Paper from which the sheet is formed is greatly influenced upon humidity to extension and contraction. In general, a high temperature condition tends to cause a high humidity condition. In any case, as the humidity is increased, the sheet is extended accordingly. Further, the sheet stacking device is expanded as the temperature is increased. Since the sheet stacking device is normally formed from resin material, it is apt to be expanded by the temperature increase. When the sheet stack is positioned at the rear side as mentioned above, if a high temperature/humidity condition occurs, the other side of the sheet stack is extended toward the front plate 114, thereby deviating the image forming reference (image formation is started from the left side of the sheet).

However, when the sheet stacking device is mounted on the system body and the sheet stacking device is positioned with respect to the system body by means of the positioning means 146 provided on the front plate, under the high temperature/humidity condition, although the sheet stack is extended toward the front plate, since the abutment member constituting the sheet reference is shifted toward the rear plate by the expansion of the sheet stacking device, the expansion of the sheet stack and the expansion of the sheet stacking device are cancelled to each other, thereby minimizing the deviation of the other side sheet conveyance reference, and, thus, preventing the deviation of the image.

Incidentally, in the above-mentioned arrangement, while an example that the abutment means comprises the abutment member was explained, the rear plate may include a reference surface and acts as an abutment means.

Figure 11:
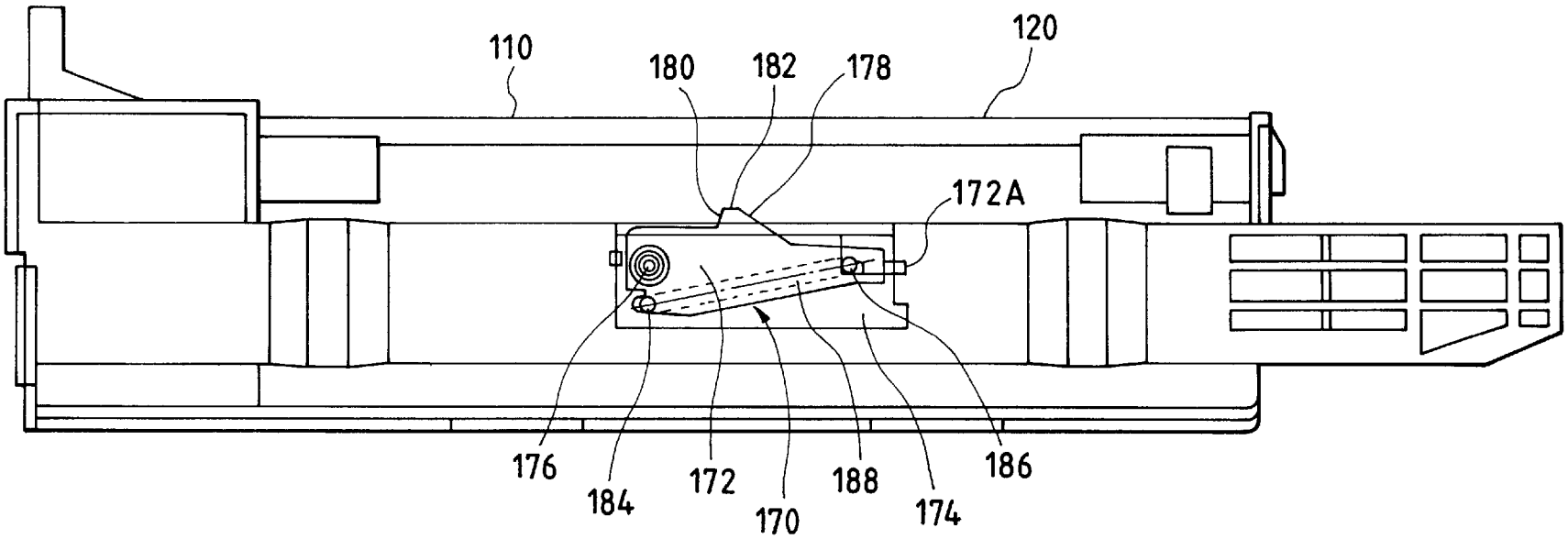
FIG. 11 is a side view of a sheet stacking portion according to a second embodiment of the present invention.
Figure 12:
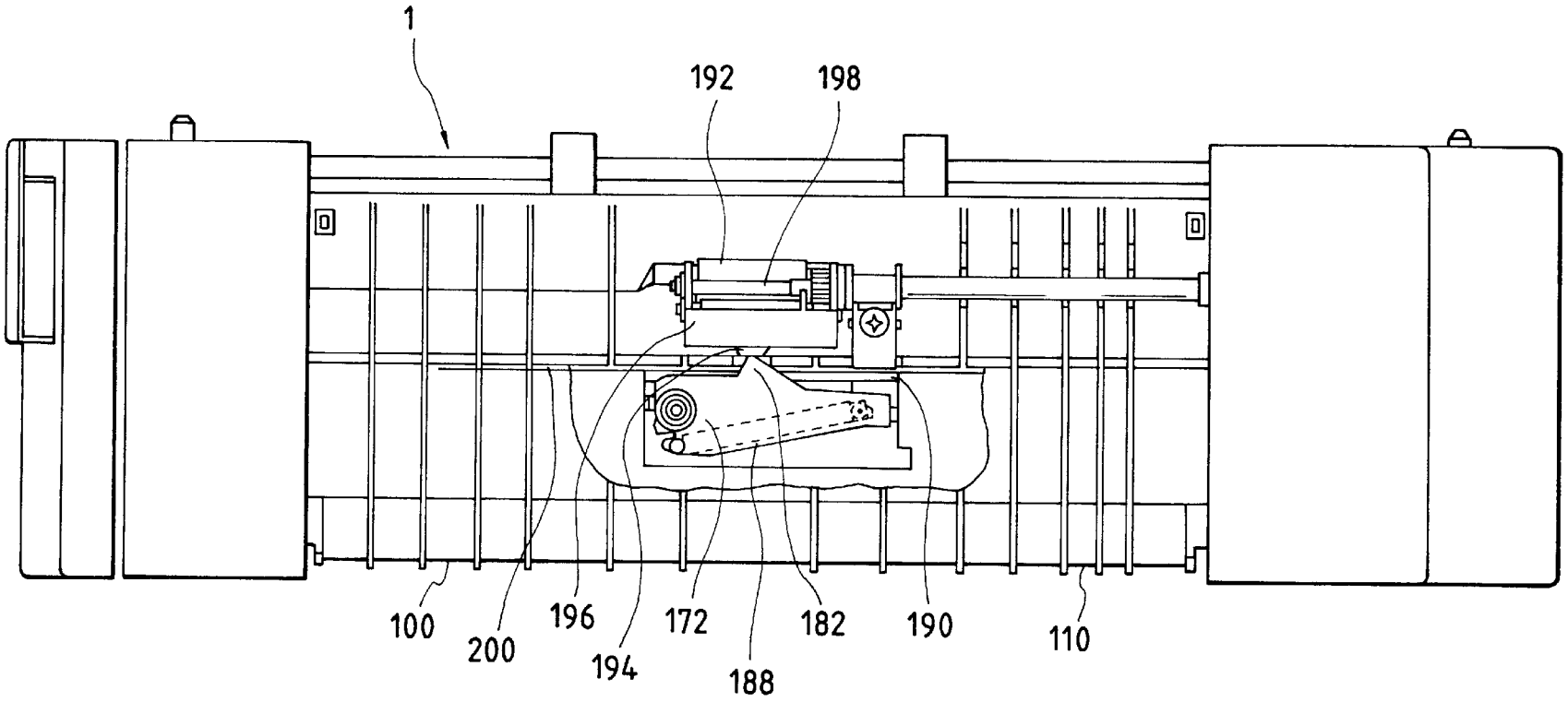
FIG. 12 is an explanatory view showing an operating condition of the sheet stacking portion of FIG. 11.
Figure 13:
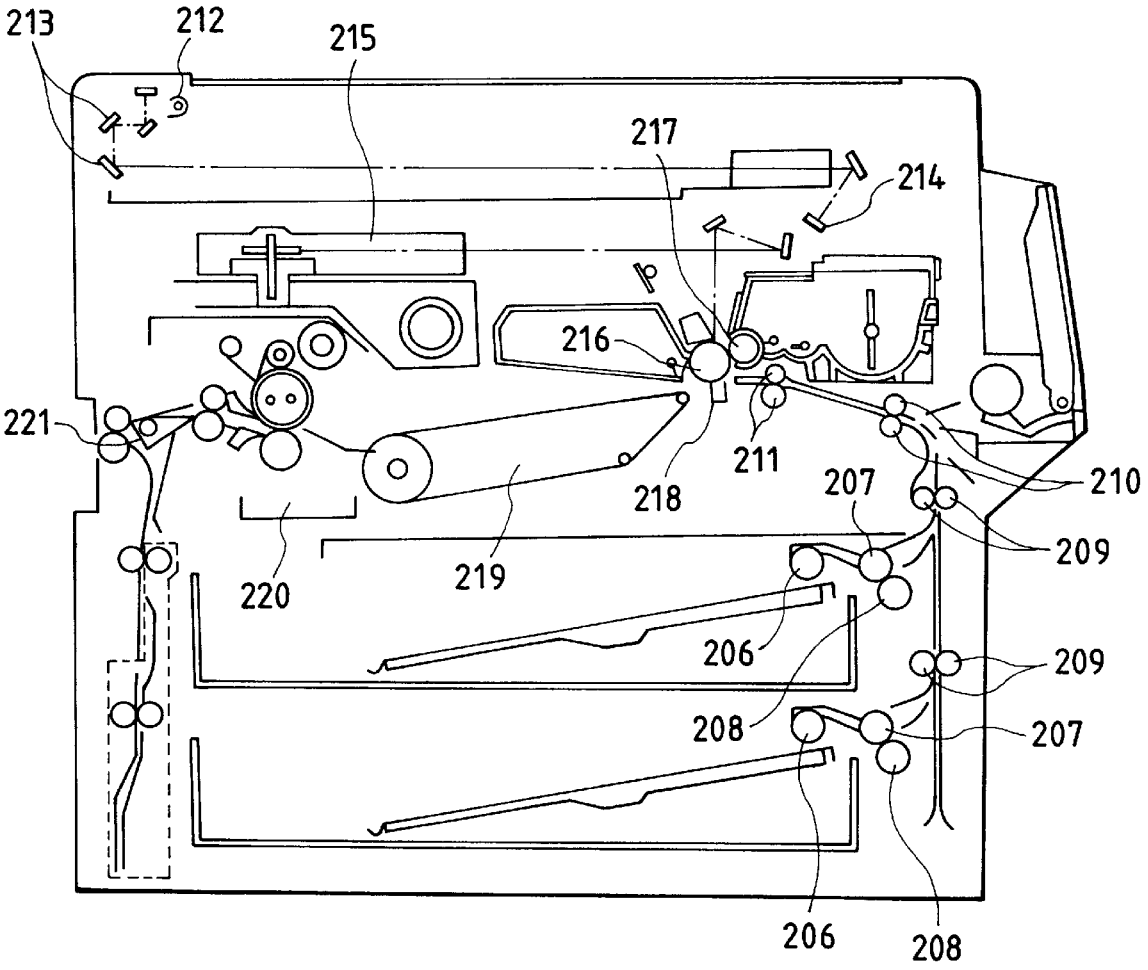
FIG. 13 PRIOR ART
FIG. 13 is a schematic sectional view of a conventional image forming apparatus.
Figure 14:
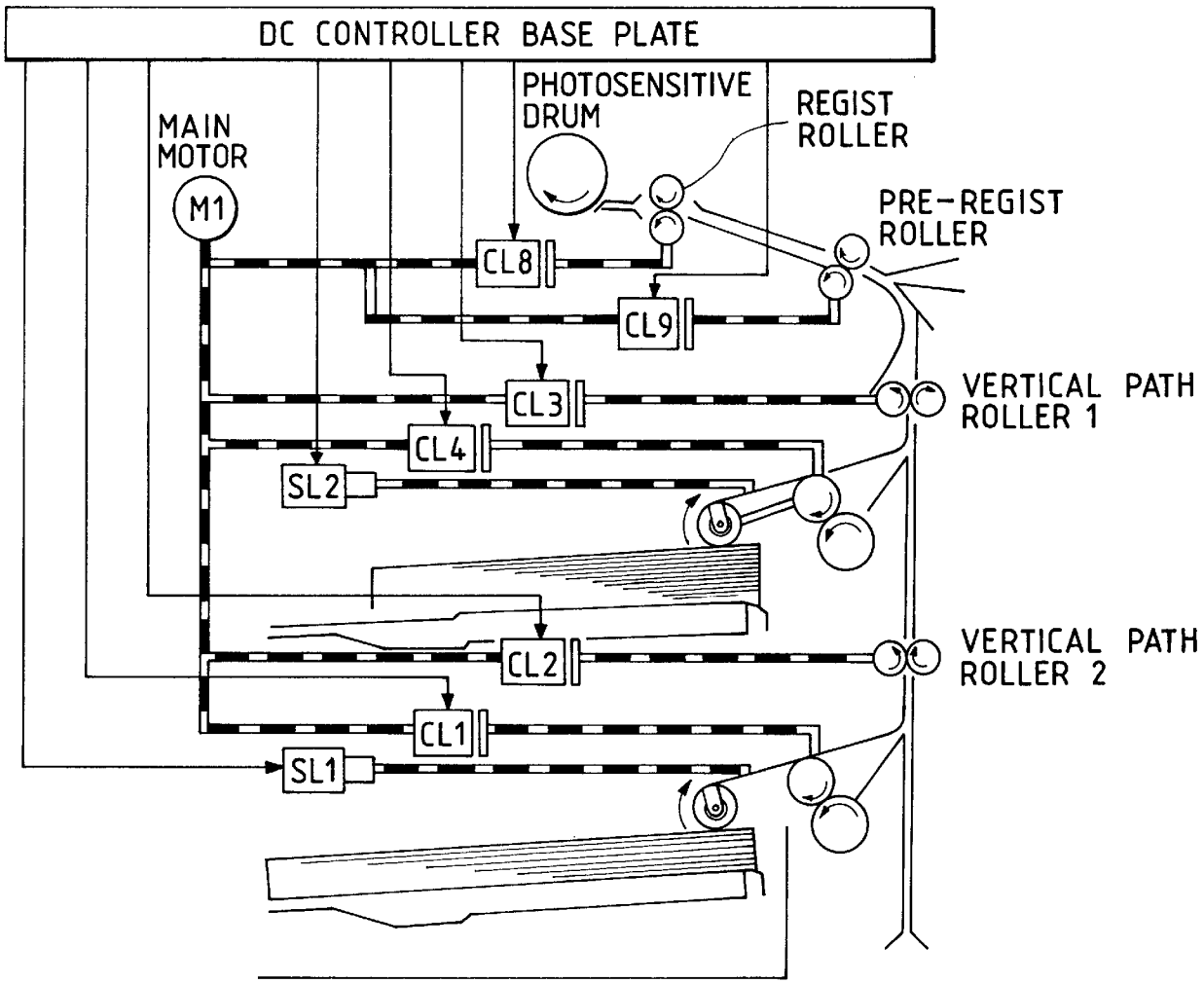
FIG. 14 PRIOR ART
FIG. 14 is a block diagram mainly showing a convey system of the conventional image forming apparatus.

In FIGS. 11 and 12, an adjustment lever 172 of a separation pressure adjusting means 170 is contained in a recessed portion 174 formed in the side plate 110 of the sheet stacking device 100 and is pivotally supported, at its one end, by the side plate 110 via a shaft 176. A projection 182 having front and rear tapered portions 178, 180 is formed on the lever 172 at its central portions. A tension spring 188 extends between a lock pin 184 formed on one end of the lever 172 and a lock pin 186 of the recessed portion 174 of the side plate 110 so that the lever 172 is biased toward an anticlockwise direction by the tension spring. Further, as shown, the tension spring has a long dimension and great spring constant so that a substantially constant urging force is applied from the lever to the retard roller during the rotation of the lever. Further, a rail 190 is provided on an upper portion of the sheet stacking device 120. Incidentally, in FIG. 11, the lever 172 is provided with a guided projection 172A which can be slidably contacted with an inner surface of an overhang portion of the recessed portion 174, thereby preventing the lever 172 from escaping out of the recessed portion.

The system body is provided with the retard roller 192 corresponding to the feed roller 50, and the retard roller is rotatably supported by a retard holder 196 having a lower projection 194. The retard holder 196 is pivotally mounted on a support shaft 198. The system body is further provided with a rail 200 corresponding to the rail 190 of the sheet stacking device 120.

According to this embodiment, when the sheet stacking device 120 is mounted to the system body 1 while guiding the device by means of the rails 190, 200, the projection 182 of the adjustment lever 172 which was pushed downwardly by the rail 200 of the system body during the mounting of the device is entered into a hole formed in the rail 200 with a click action at the final stage of the mounting operation. With this action, the operator can recognize the fact that the sheet stacking device was mounted to the system body to stop the further inserting movement of the sheet stacking device, thereby preventing the deviation from the sheet conveyance reference due to the collision of the sheet stacking device against the system body.

Figure 8:
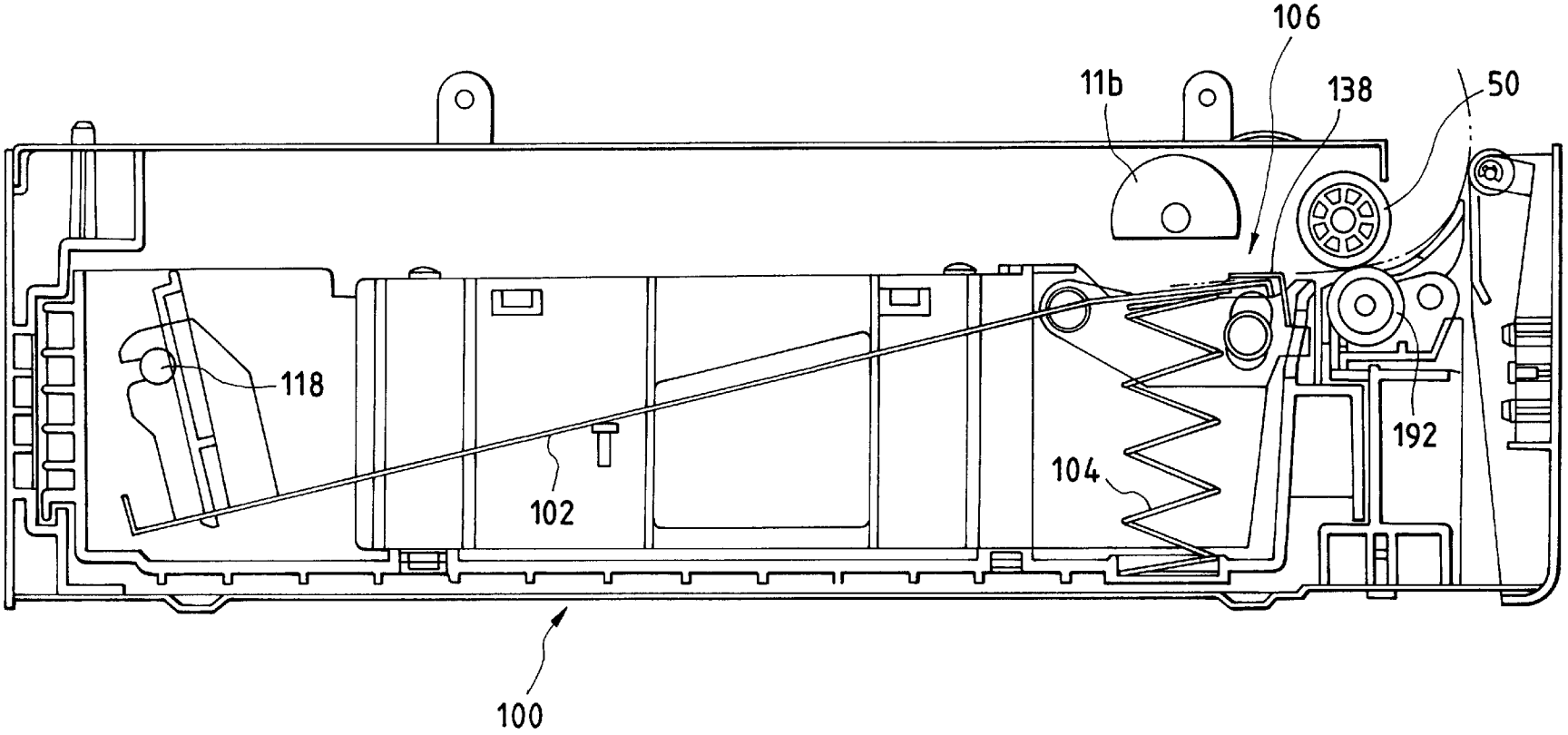
FIG. 8 is a sectional view taken along the line 8—8 in FIG. 7.
Figure 9:
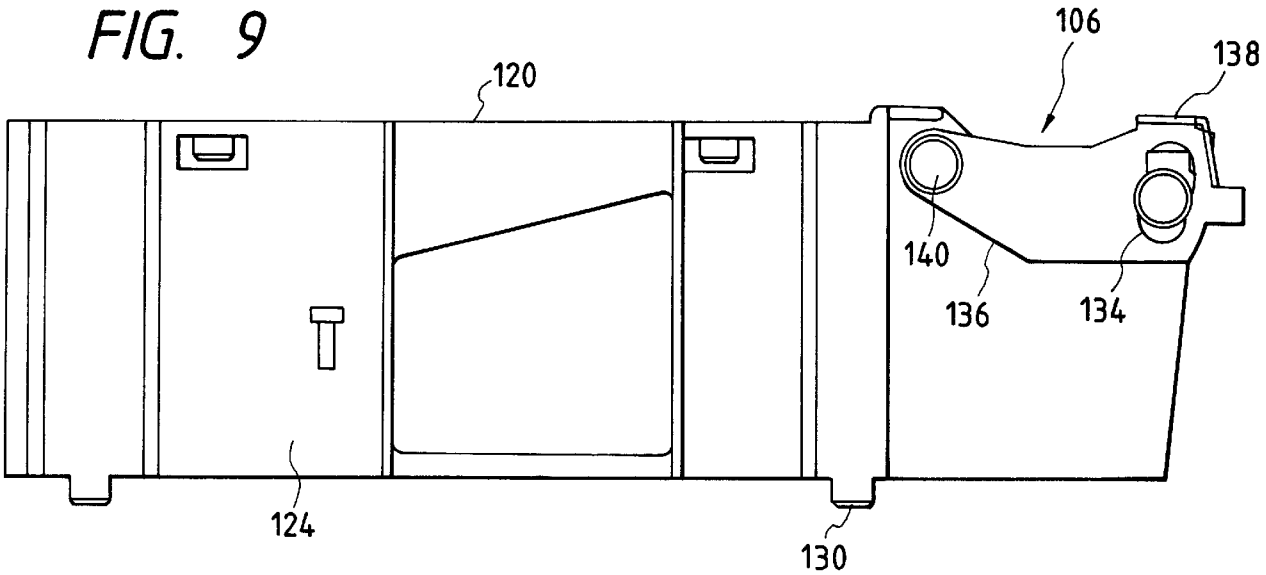
FIG. 9 is a front view of an abutment member of the sheet stacking portion of FIG. 7.
Figure 10:
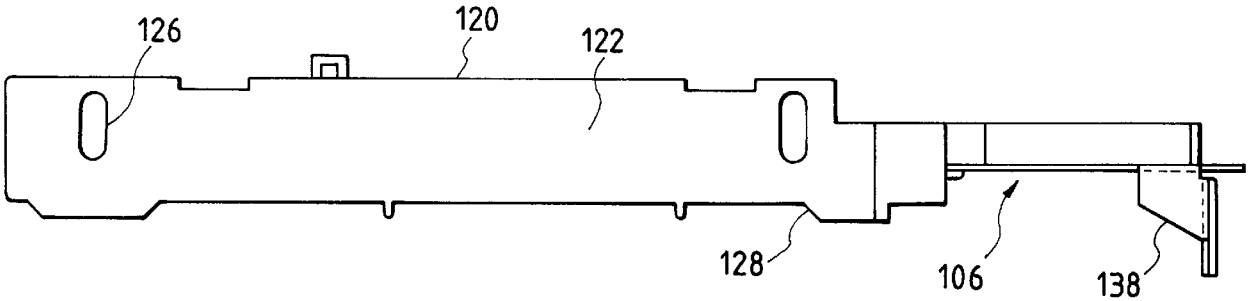
FIG. 10 is a plan view of the abutment member of the sheet stacking portion of FIG. 7.

When the sheet stacking device is mounted to the system body as mentioned above, the projection 182 of the adjustment lever 172 is engaged by the projection 194 of the retard holder 196, with the result that the retard holder 196 is lifted in accordance with the biasing force of the spring 188, thereby urging the retard roller against the feed roller 50 with desired separation pressure (FIG. 8). In this way, since the separation pressure adjustment means is provided on the sheet stacking device side, replacement and/or adjustment of parts of the adjusting means can be performed in a condition that the sheet stacking device is dismounted from the system body, thereby facilitating the work. Further, since the friction separation means is provided on the body side, it is not deteriorated by oil from the operator's fingers. Incidentally, in this embodiment, which an example that the separation pressure of the retard roller is adjusted by the adjusting means was explained, such adjusting means may be applied to other friction separation means such as a friction pad.

As mentioned above, in the sheet supplying apparatus according to the present invention, since the pick-up roller and the retard roller are rotated synchronously to effect the sheet supplying operation, unlike to the conventional technique, there is no need to provide electromagnetic clutches for independently controlling the pick-up roller and the retard roller, thereby making the construction simpler. Further, since the feed roller and the retard roller are interconnected through the torque limiter, if the sheets are double-fed while the sheets are being conveyed by the downstream convey roller portion, the driven rotation of the feed roller is transmitted to the retard roller, thereby eliminating the double-feed of sheets. Furthermore, since the action of the one-way clutch for permitting the driven rotation of the feed roller by the movement of the sheet being conveyed by the downstream convey roller portion can be effected by the spring clutch for rotating the retard roller by one revolution, the number of parts is reduced, thereby making the construction simpler and reducing the manufacturing cost.

What is claimed is:

1. A sheet supplying apparatus comprising:

a feed means rotatable in a sheet feed direction;

a retard means capable of being urged against said feed means for separating sheets one by one between said retard means and said feed means by rotating in a direction opposite to the sheet feed direction;

a first drive transmitting means capable of transmitting or interrupting a drive force from a drive source to said feed means and said retard means;

a second drive transmitting means for transmitting a rotation of said feed means to said retard means so as to rotate said retard means in a direction opposite to the sheet feed direction; and a convey means disposed downstream of said feed means in the sheet feed direction for receiving and conveying the sheet fed out by said feed means which is rotated by the drive force transmitted by said first drive transmitting means;

wherein after the sheet fed out by said feed means reaches the convey means, said first drive transmitting means changes its condition from a drive transmission condition to a drive interruption condition, and the rotation of said feed means rotated by the sheet conveyed by said convey means is transmitted to said retard means by said second drive transmitting means.

2. A sheet supplying apparatus according to claim 1, wherein said first drive transmitting means includes a drive control means for transmitting the driving force to said feed means until the sheet fed out by said feed means reaches said convey means and for bringing said first drive transmitting means to the drive interruption condition after the sheet reaches said convey means.

3. A sheet supplying apparatus according to claim 2, wherein said drive control means has a one-way clutch, and the drive interruption condition is achieved when an arm of a lever is engaged by a projection of said one-way clutch while the drive transmission condition is achieved when said arm is disengaged from said projection.

4. A sheet supplying apparatus according to claim 3, further comprising a pick-up means for feeding the sheets from a sheet supporting means for supporting a plurality of sheets, and the driving force is transmitted from said first drive transmitting means to said pick-up means.

5. A sheet supplying apparatus according to claim 4, wherein said pick-up means is a semi-circular roller having a cut-out portion and a rotation of said semi-circular roller is controlled by a one-revolution control means in such a manner that said cut-out portion is stopped to be opposed to the sheet whenever said roller is rotated by one revolution, and the driving force is transmitted from said first drive transmitting means to said one-revolution control means.

6. A sheet supplying apparatus according to claim 5, further comprising a cam means one revolution of which is controlled by said one-revolution control means, and said one-way clutch is operated by effecting engagement and disengagement between said arm and said projection by rocking said lever by a rotation of said cam means.

7. A sheet supplying apparatus according to claim 6, wherein said one-revolution control means has a notched gear capable of being engaged by a drive gear connected to the drive source, a solenoid for regulating said notched gear at a position where a notched portion of said notched gear is opposed to said drive gear, and a biasing means for rotating said notched gear to be engaged by said drive gear when the regulation of said solenoid is released.

8. A sheet supplying apparatus according to claim 5, further comprising an elastic member for biasing said sheet supporting means toward said pick-up means and a regulating member for maintaining an uppermost surface of the sheets supported by said sheet supporting means to a predetermined height, and when said cut-out portion of said pick-up means is opposed to the sheet, said pick-up means is spaced apart from the sheet.

9. A sheet supplying apparatus according to claim 1, wherein said second drive transmitting means has a torque limiter for transmitting torque smaller than predetermined torque.

10. A controlling method for controlling a sheet supplying means, comprising the steps of:

separating sheets one by one between a feed means to which a driving force is transmitted from a drive source and which is rotated in a sheet feed direction, and a retard means to which a driving force is transmitted from said drive source and which is rotated in a direction opposite to the sheet feed direction;

interrupting the transmission of the driving force from said drive source to said feed means and said retard means, after conveyance of the sheet separated by said feed means and said retard means is started by a convey means disposed downstream in the sheet feed direction; and transmitting a rotation of said feed means rotated by the sheet conveyed by said convey means to said retard means so as to rotate said retard means in a direction opposite to the sheet feed direction, after the transmission of the driving force from said drive source is interrupted.

11. A controlling method according to claim 10, wherein the transmission of rotation from said feed means to said retard means is interrupted by a torque limiter when a single sheet is pinched between said retard means and said feed means.

12. A controlling method according to claim 11, wherein the stacked sheets are fed out to said feed means by said pick-up means.

13. An image forming apparatus comprising:

a feed means rotatable in a sheet feed direction;

a retard means capable of being urged against said feed means and for separating sheets one by one between said retard means and said feed means by rotating in a direction opposite to the sheet feed direction;

a first drive transmitting means capable of transmitting or interrupting a driving force from a drive source to said feed means and said retard means;

a second drive transmitting means for transmitting a rotation of said feed means to said retard means so as to rotate said retard means in a direction opposite to the sheet feed direction;

a convey means disposed downstream of said feed means in the sheet feed direction for receiving and conveying the sheet fed out by said feed means which is rotated by the drive force transmitted by said first drive transmitting means; and an image forming means for forming an image on the sheet conveyed by said convey means;

wherein after the sheet fed out by said feed means reaches the convey means, said first drive transmitting means changes its condition from a drive transmission condition to a drive interruption condition and the rotation of said feed means rotated by the sheet conveyed by said convey means is transmitted to said retard means by said second drive transmitting means.

14. A controlling method for controlling an image forming apparatus, comprising the steps of:

separating sheets one by one between a feed means to which a driving force is transmitted from a drive source and which is rotated in as sheet feed direction, and a retard means to which a driving force is transmitted from said drive source and which is rotated in a direction opposite to the sheet feed direction;

interrupting the transmission of the driving force from said drive source to said feed means and said retard means, after conveyance of the sheet separated by said feed means and said retard means is started by a convey means disposed downstream in the sheet feed direction;

transmitting a rotation of said feed means rotated by the sheet conveyed by said convey means to said retard means so as to rotate said retard means in a direction opposite to the sheet feed direction after the transmission of the driving force from said drive source is interrupted, thereby preventing double-feed of sheets; and forming an image on the sheet fed out without the double-feed by means of an image forming means.

15. A sheet supplying apparatus for separating and supplying stacked sheets comprising:

sheet separating means for separating the sheets, said sheet separating means having feed means rotatable in a sheet feed direction and retard means rotatable in a direction opposite to the sheet feed direction to separate sheets one by one therebetween;

drive transmitting means for transmitting a drive force from a drive source to said feed means;

rotation transmitting means for transmitting a rotation of said feed means to said retard means so as to rotate said retard means in a direction opposite to the sheet feed direction;

convey means disposed downstream of said feed means in the sheet feed direction for conveying the sheet separated by said sheet separating means; and drive control means for interrupting the transmission of the drive force to the feed means by said drive transmitting means, after the sheet separated by said separating means reaches said convey means;

wherein when said drive control means interrupts the transmission of the drive force by said drive transmitting means, said feed means is rotated by the sheet being conveyed by said convey means, and rotation of said feed means is transmitted to said retard means by said rotation transmitting means.

16. A sheet supplying apparatus according to claim 15, wherein said rotation transmitting means has a torque limiter.

17. A sheet supplying apparatus according to claim 16, wherein said rotation transmitting means has a gear train and said torque limiter is disposed in said gear train.

18. A sheet supply apparatus according to claim 15, wherein said drive control means has a one-way clutch and control arm which controls said one-way clutch so that the transmission of the drive force by said drive transmitting means is interrupted by engagement of said control arm to said one-way clutch.

19. A sheet supply apparatus according to claim 15, further comprising a pick-up means for feeding the sheets from a sheet supporting means for supporting the stacked sheets to said separating means, said pick-up means is transmitted the drive force from said drive transmitting means.

20. An image forming apparatus for forming an image to a sheet separated and supplied from stacked sheets comprising:

sheet separating means for separating the sheets, said sheet separating means having feed means rotatable in a sheet feed direction and retard means rotatable in a direction opposite to the sheet feed direction, and sheets being separated one by one between said feed means and retard means;

drive transmitting means for transmitting a drive force from a drive source to said feed means;

rotation transmitting means for transmitting a rotation of said feed means to said retard means so as to rotate said retard means in a direction opposite to the sheet feed direction;

convey means disposed downstream of said feed means in the sheet feed direction for conveying the sheet separated by said sheet separating means;

drive control means for interrupting the transmission of the drive force to the feed means by said drive transmitting means after the sheet separated by said separating means reaches said convey means; and image forming means for forming the image conveyed by said convey means;

wherein when said drive control means interrupts the transmission of the drive force by said drive transmitting means, said feed means is rotated by the sheet conveyed by said convey means, and rotation of said feed means is transmitted to said retard means by said rotation transmitting means.

* * * * *

UNITED STATES PATENT AND TRADEMARK OFFICE

CERTIFICATE OF CORRECTION

PATENT NO. : 5,860,645

DATED : January 19, 1999

INVENTOR(S) : HISAYUKI TOMURA, ET AL.

It is certified that error appears in the above-identified patent and that said Letters Patent is hereby corrected as shown below:

COLUMN 4,
Line 54, "10ais" should read --10a is--;
Line 60, "10aof" should read --10a of--; and
Line 64, "10awas" should read --10a was--.

COLUMN 13,
Line 8, "condition and" should read --condition, and--.

Signed and Sealed this

Twenty-fourth Day of August, 1999

*Attest:*

Q. TODD DICKINSON

*Attesting Officer*

*Acting Commissioner of Patents and Trademarks*